United States Patent [19]

Voss

[11] Patent Number: 4,752,064

[45] Date of Patent: Jun. 21, 1988

[54] THERAPEUTIC HEAD SUPPORT

[76] Inventor: Gene Voss, 7614 Louis Pasteur, Ste. 200, San Antonio, Tex. 78229

[21] Appl. No.: 29,224

[22] Filed: Mar. 23, 1987

[51] Int. Cl.[4] ..... A61G 13/00

[52] U.S. Cl. ..... 269/328; 5/435

[58] Field of Search ..... 269/328; 5/434–437, 5/440; 128/1 R, 21, 22

[56] References Cited

U.S. PATENT DOCUMENTS

| | | | |
|---|---|---|---|
| D. 271,834 | 12/1983 | Huntsinger | 5/435 |
| 1,968,120 | 7/1934 | Barghausen et al. | 269/328 |
| 2,470,026 | 5/1949 | Freund | 269/328 |
| 3,337,883 | 8/1967 | Allison | 5/435 |
| 3,366,106 | 1/1968 | Yao et al. | 5/435 |
| 3,694,831 | 10/1972 | Treace | 5/435 |
| 3,808,615 | 5/1974 | Geary | 5/435 |
| 3,828,377 | 8/1974 | Fary | 5/435 |
| 3,926,181 | 12/1975 | Eischen | 5/436 |
| 4,259,757 | 4/1981 | Watson | 5/434 |
| 4,504,050 | 3/1985 | Osborne | 269/328 |

FOREIGN PATENT DOCUMENTS

| | | | |
|---|---|---|---|
| 768163 | 8/1934 | France | 5/435 |

*Primary Examiner*—Robert C. Watson

*Attorney, Agent, or Firm*—Gunn, Lee & Jackson

[57] ABSTRACT

A therapeutic device for supporting the head face down during an operation. The device is comprised of a pillow having a T-shaped void therein conforming to the contours of the face. One or more channels may be cut in the pillow to provide airways or allow insertion of a tube into the patient's mouth. A support structure is also described for use with the pillow. The support structure allows the patient's face to be seen, even while lying down, and consists of a plate attached to the end of a table by clamps, having a mirror below whose orientation may be adjusted.

3 Claims, 2 Drawing Sheets

THERAPEUTIC HEAD SUPPORT

BACKGROUND OF THE INVENTION

1. Field of the Invention

The present invention generally relates to pillows and cushioned supports, and more speicifically to a support for the head during an operation.

2. Description of the Prior Art

Our society is one of luxury and affluence. We are constantly devising new ways to surround ourselves in serenity and comfort. One way this is accomplished is through the use of soft, supportive pillows, whether it be on the couch, in bed, or in any one of a hundred other places. But pillows and other support structures can have a much greater importance.

For example, millions of operations are performed each year which require that the patient have some sort of lateral or subjacent support of some part of the body. A prime example involves heart surgery. It is critica lto keep the legs properly supported during open heart surgery. Many patents are directed to such devices. Notably, Donald Spann has invented several leg positioners for this purpose, among them U.S. Pats. Nos. 3,931,654; 4,185,813; 4,471,952; and 4,482,138.

Other orthopedic supports are shown in U.S. Pats. Nos. 4,327,714 also issued to Spann; 2,478,497 issued to Morrison, and 4,473,913 issued to Ylvisaker. Unfortunately none of these devices are directed to use with the head. Many common procedures require that the head be placed in an unusual position. Every dentist's office is equipped with a special device for supporting the head face-up during dental examination. A problem arises, however, in those situations wherein the patient must be face down. The use of standard head supports would be uncomfortable, and normal pillows would suffocate the user. Typically, the patient must turn his or her head sideways or support the forehead with an extra cushion. This is undesirable as it causes the cervial region of the spine to either be twisted or bent in a very uncomfortable manner. Not only would this give the patient a tremendous headache, but it may be critical for purposes of the operation to keep the neck straight.

The Ylvisaker patent referenced above shows one way in which this problem has been minimized. A simple channel has been cut in the pillow to accommodate the face, providing an unobstructed air passageway. There are still many drawbacks to this design. First of all, it is practically impossible to view the patient's face in order to determine his or her state of awareness, which can be critical in cases where the patient has been anaesthetized and constant supervision of his outward demeanor is necessary. It would also be beneficial to be able to freely communicate with the patient. Moreover, the design depicted in Ylvisaker cannot support those having narrow faces, or, alternatively, would be extremely uncomfortable due to lack of conformity of the channel surface to the contours of the face. Finally, it is often necessary to place one or more tubes into the patient's mouth, which is not feasible with the Ylvisaker or similar devices. It would therefore be desirable and advantageous to devise a face pillow which would comfortably support the face and yet avoid the foregoing problems.

SUMMARY OF THE INVENTION

Accordingly, the primary object of the present invention is to provide a therapeutic head support or pillow for supporting the head while the user is lying face down.

Another object of the invention is to provide such a pillow which will comfortably support the face.

Still another object of the invention is to provide such a pillow which allows the use of tubes and the like which lead to the user's mouth.

Yet another object of the invention is to provide means by which the user may converse with those around him while lying on the pillow.

The foregoing objects are achieved in a pillow having a void therein whose surface is contoured to the shape of a human face, having one or more channels therein for tubing, and having the necessary support structure to allow the patient to communicate with others through the pillow.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of illustrative embodiments when read in conjunction with the accompanying drawings, wherein:

DESCRIPTION OF THE PREFERRED EMBODIMENTS

Figure 1:
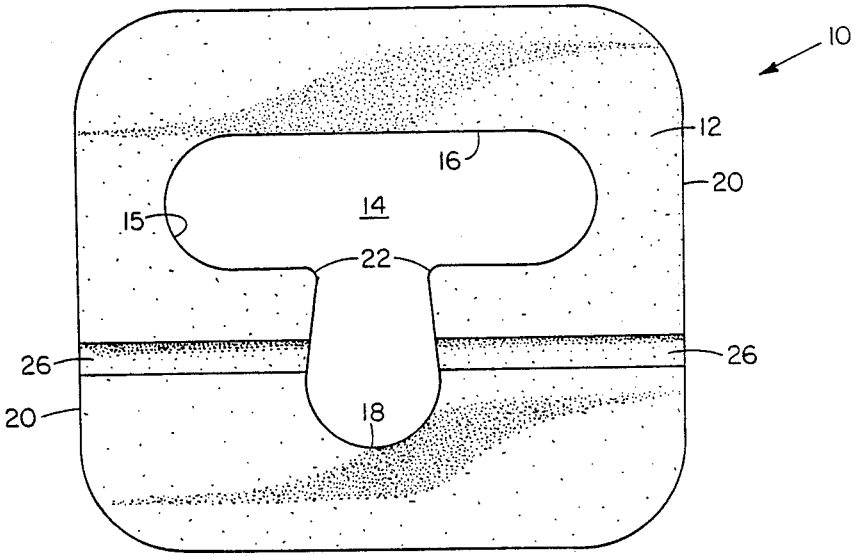
FIG. 1 is a top view of the head support of the present invention.
Figure 2:
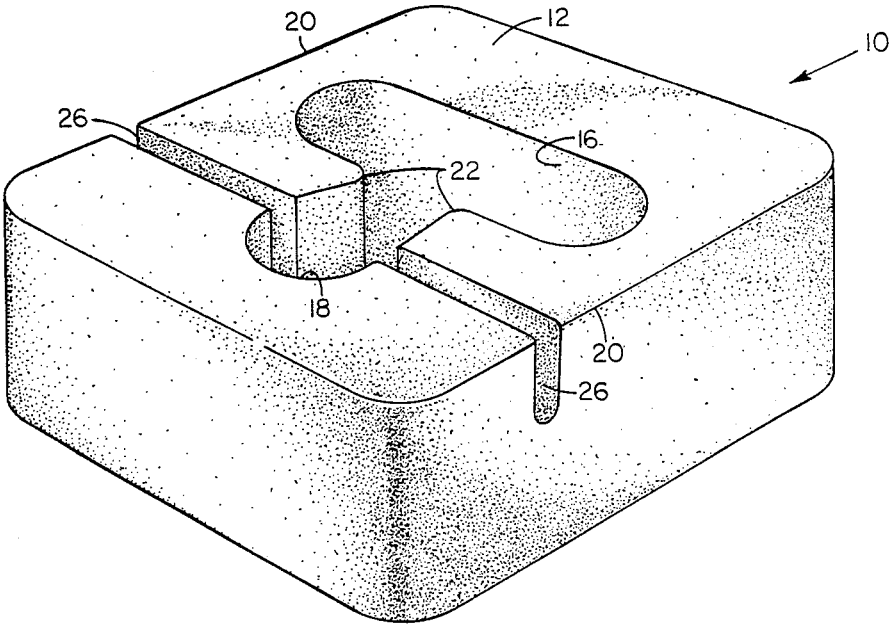
FIG. 2 is a perspective view of the support as shown in FIG. 1.

With reference now to the figures, and in particular with reference to FIGS. 1 and 2, there is depicted therapeutic head support 10, generally comprised of pillow 12 having a void 14 therein, extending completely through the pillow. The pillow 12 is preferably made of a resilient closed cell medical foam such as polyurethane. Edges 20 may be rounded, but as pillow 12 is made of relatively soft foam, the edges may just as easily be at right angles, simplifying manufacture.

Head support 10 is designed for use with patients who must be in a facedown prone position. The most common procedure wherein support 10 may be utilized is back surgery, such as for a laminectomy, discectomy, foraminotomy, or decompression, whether it be in the cervical, thoracic, lumbar, or sacral portions of the back. The device may also be useful in other procedures, such as a hemorrhoidectomy. Although support 10 is directed toward a therapeutic use, it obviously may be used anywhere, such as at home when the user might want to lie face down for excercises, massage, etc.

Preferably, pillow 12 is square in cross-section, and measures about nine inches along a side, although its length may vary between six and twelve inches. The pillow 12 may come in other shapes, e.g., circular, or be wider, but excess length is unnecessary as it does not add significantly to the resilience or other features of the support. Obviously, pillow 12 may be smaller if it is to be used with children, and it is anticipated that small, medium, and large sizes will be available. In each case, the thickness of pillow 12 is envisioned as being about four inches, although it may range from two to six inches. Excess thickness is undesirable as this would raise the neck above the operating table and strain the cervical area of the spine. Thicknesses less than two inches will not provide sufficient cushioning.

Pillow 12 has a generally T-shaped void 14 therein. The shape of void 14 provides total support for the head but does not interfere with the critical facial areas of the mouth, nose and eyes. The upper portion 16 of void 14 has a length of between four and seven inches depending on the age of the intended user. Thus the patient may see through pillow 12 at the upper portion 16 of void 14, avoiding any claustrophobic effect. Void 14 also provides an unobstructed passageway for air. Lobes 22 protrude slightly inward toward the center of the void, providing extra support at the cheekbones. Alternatively phrased, the lower portion 18 of void 14 is slightly widened, allowing some freedom of movement of the mouth so that the patient may converse with the attending physician. The inner edge 15 of void 14 is preferably curved at the extended portions of the T shape, rather than being square cut, providing maximum surface contact with the face, and thus maximum support.

Figure 3:
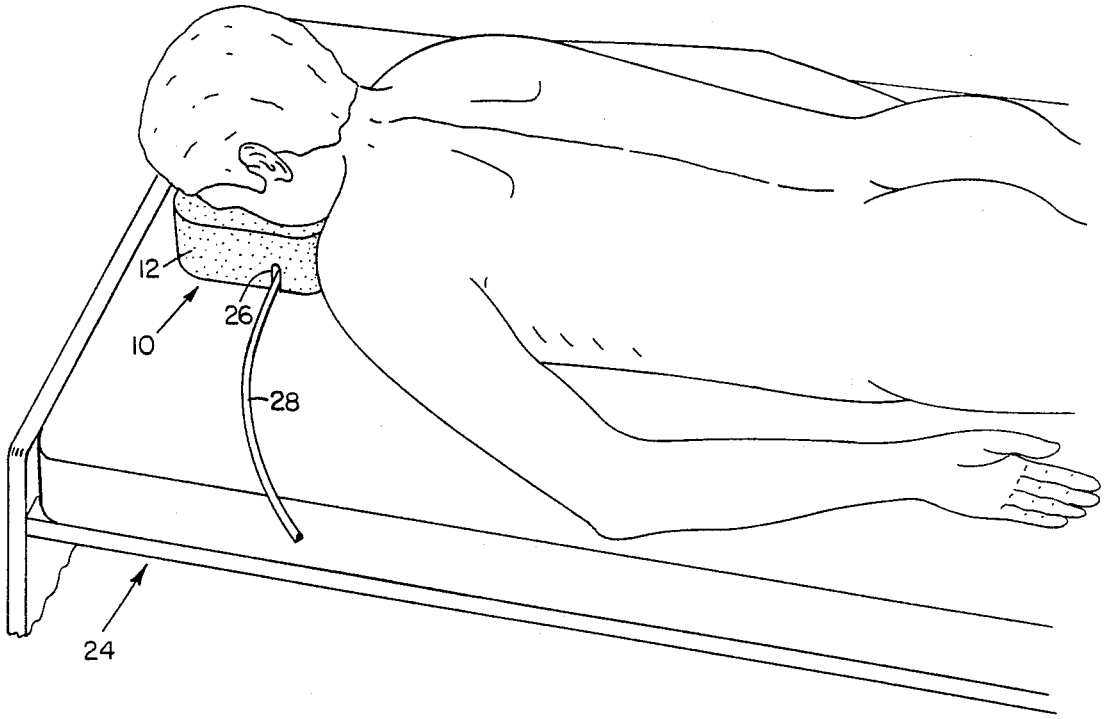
FIG. 3 is a perspective view showing a patient lying face down on a conventional operating table with his head supported by the therapeutic head support of the present invention.
Figure 4:
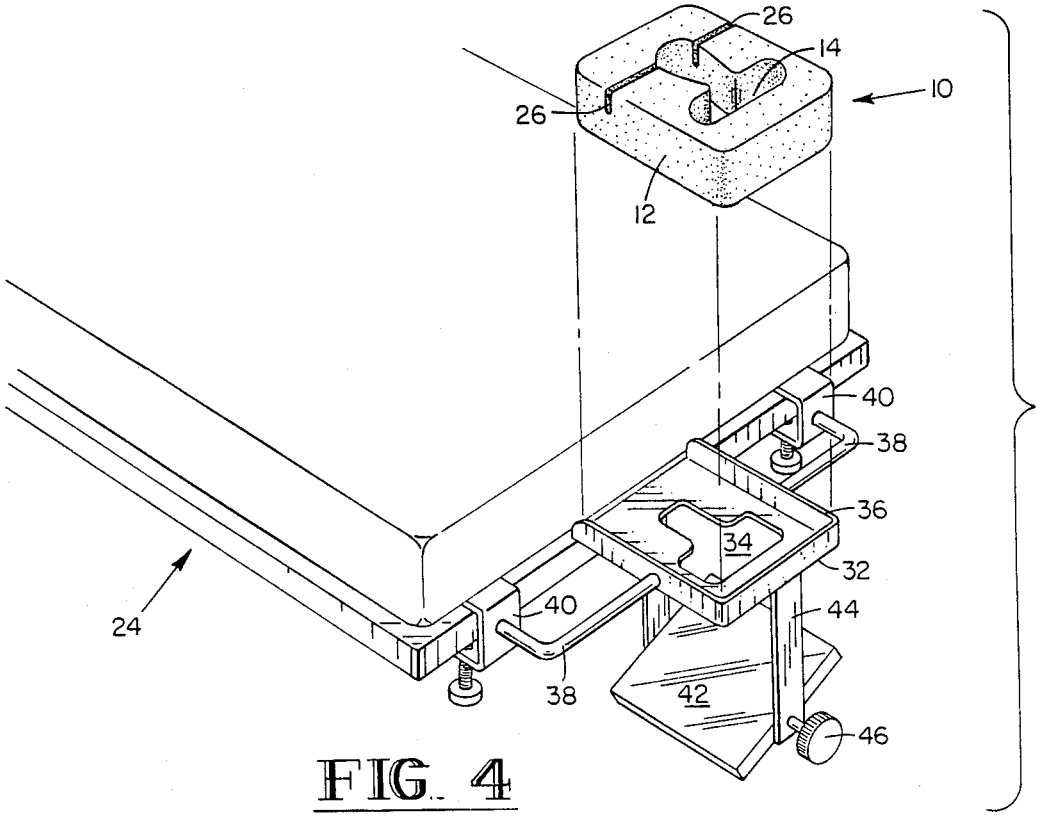
FIG. 4 is a exploded perspective view showing the head support resting on a metal plate extending from the operating table, with a mirror situated below.

FIGS. 1 and 2 depict pillow 12 as having two channels 26 therein running from void 14 to the outside of pillow 12. With further reference to FIG. 3, in the event that the head support 10 is used without the appurtenant support structures discussed below, the pillow 12 is placed directly onto the operating table 24. In this case, channels 26 may serve as airways and, if necessary, a microphone (not shown) may be placed near the patient's mouth, i.e., on lower portion 18 of void 14. If, however, the patient is unconscious, an endotracheal tube 28 may be inserted into the patient's mouth and trachea viz either one of channels 26. This provides total control over the patient's airways, obviously critical in any surgical procedure.

It may be desirable to allow visual and audible communication between the surgeon and the patient during an operation. In most back surgeries this is necessary as peripheral nerve conduction may be checked by known techniques of somatosensory evoked potential. In some cases, however, patient input is extremely benefical. For this reason, a special support system 30 may be used with pillow 12 as depicted in FIG. 3. In this embodiment, pillow 12 is immediately supported by a plate 32, preferably metal, which has therein a cutout 34 similar in shape to, but slightly larger than, void 14 in pillow 12. Plate 32 has flanged edges 36 which keep pillow 12 properly aligned therein. Plate 32 is attached to operating table 24 in any expedient manner; in FIG. 3, plate 32 is in turn supported by support rods 38 which are welded to clamps 40. Clamps 40 are easily secured to the end of table 24.

With the support system 30 as so far described, the patient's face is visible, but only from below the operating table. For this reason, it is envisioned that a mirror 42 may be placed below plate 32 and connected thereto by means of support bars 44. The mirror 42 may conveniently be adjusted by means of knob 46. Mirror 42 may be slightly concave to allow some magnification. Thus, the physician may interrogate the patient on certain medical indicia, and receive audible responses as well as noting the visual demeanor of the patient. alternatively, a video camera may be placed below the patient, displaying his face on a cathode ray tube visible to the surgeon. A TV monitor could instead be placed below the patient, allowing him to view the operation.

Although the invention has been described with reference to specific embodiments, this description is not meant to be construed in a limiting sense. Various modifications of the disclosed embodiment, as well as alternative embodiments of the invention will become apparent to persons skilled in the art upon reference to the description of the invention. It is therefore contemplated that the appended claims will cover such modifications that fall within the true scope of the invention.

I claim:

1. A therapeutic head support comprising:

a pillow made of soft resilient foam being between two and four inches thick;

said pillow having a T-shaped void theerein conforming to the contours of a human face;

said pillow having a channel therein extending from said void to an outer surface of said pillow;

a plate member having a cutout therein for supporting said pillow, said cutout corresponding to said void;

rod members attached to said plate member;

clamping means connected to said rod members for attaching said plate member to a table;

a mirror attached to said plate member opposite said pillow; and means for adjusting the orientation of the miror.

2. A therapeutic head support comprising:

a pillow member having upper and lower surfaces and having a T-shaped void therein for receiving a human face at said upper surface;

a plate member whose dimensions correspond to the cross-sectional dimensions of said pillow member, said plate member having a cutout there-through corresponding to said void in said pillow member, and having a flanged edge for securing said pillow member thereto;

one or more rod members having first and second ends;

one or more clamp members, said first end of said one or more rod members being attached to said plate member, and said second end of said one or more rod members being attached to said one or more clamp members;

one or more bar members having first and second ends, said first end being attached to said plate member;

a mirror attached to said second end of said one or more bar members; and knob means for adjusting the orientation of said mirror.

3. The therapeutic head support of claim 2 wherein said pillow member has one or more channels therein extending from said void to an outer surface of said pillow member.

* * * * *